US008856970B2

(12) United States Patent
French

(10) Patent No.: US 8,856,970 B2
(45) Date of Patent: Oct. 14, 2014

(54) GARMENT POCKET FOR CARRYING AN OBJECT IN A CONCEALED STATE

(71) Applicant: CCW Breakaways LLC, New Cumberland, PA (US)

(72) Inventor: Jay French, New Cumberland, PA (US)

(73) Assignee: CCW Breakaways LLC, New Cumberland, PA (US)

( * ) Notice: Subject to any disclaimer, the term of this patent is extended or adjusted under 35 U.S.C. 154(b) by 0 days.

(21) Appl. No.: 13/915,145

(22) Filed: Jun. 11, 2013

(65) Prior Publication Data

US 2013/0269086 A1 Oct. 17, 2013

Related U.S. Application Data

(62) Division of application No. 12/242,082, filed on Sep. 30, 2008, now Pat. No. 8,484,765.

(60) Provisional application No. 61/048,043, filed on Apr. 25, 2008.

(51) Int. Cl.

| | |
|---|---|
| ***A41D 27/20*** | (2006.01) |
| ***F41C 33/00*** | (2006.01) |
| ***F41C 33/02*** | (2006.01) |
| ***F41C 33/04*** | (2006.01) |
| *A41D 1/06* | (2006.01) |

(52) U.S. Cl.

CPC ..... *F41C 33/00* (2013.01); *A41D 27/20* (2013.01); *F41C 33/0209* (2013.01); *F41C 33/0218* (2013.01); *F41C 33/048* (2013.01); *A41D 1/06* (2013.01)

USPC ..... 2/251; 2/250

(58) Field of Classification Search

CPC ... A41D 27/20; A41D 27/201; A41D 27/202; A41D 27/205; A41D 27/207; A41D 2600/108; A41D 1/06; A41D 1/065; F41C 33/0218; F41C 33/048

USPC ..... 2/247, 248, 249, 250, 251, 252, 253, 2/254, 227, 228, 79, 219, 235, 236, 237; 224/193, 587, 194, 198

See application file for complete search history.

(56) References Cited

U.S. PATENT DOCUMENTS

| | | | | |
|---|---|---|---|---|
| 198,753 | A | 1/1878 | Perry | |
| 309,292 | A | 12/1884 | Browne | |
| 738,168 | A | 9/1903 | Delavoye | |
| 825,189 | A | 7/1906 | Clark et al. | |
| 844,539 | A | 2/1907 | Rosenquist | |
| 936,437 | A | 10/1909 | Fields et al. | |
| 947,047 | A * | 1/1910 | Wald | 2/251 |
| 1,039,040 | A | 9/1912 | Elder | |
| 1,116,643 | A | 11/1914 | Strobel | |
| 1,120,190 | A | 12/1914 | Gaskill | |
| 1,146,685 | A | 7/1915 | Bernstein | |

(Continued)

*Primary Examiner* — Alissa L Hoey

(57) ABSTRACT

A pocket for a garment is disclosed. The pocket comprises a first layer and a second layer, which is attached to the first layer to form a partially enclosed space. The partially enclosed space comprises a region defined by a first line corresponding substantially to a line of flexion of a hip joint of a wearer of the garment and a second line corresponding substantially to a centerline of a thigh of a wearer of the garment. The region is configured and disposed to substantially conceal an object stored in the region from a person viewing the garment.

8 Claims, 11 Drawing Sheets

(56) References Cited

U.S. PATENT DOCUMENTS 1,161,435 A 11/1915 Baker
1,191,339 A 7/1916 Noye
1,212,513 A 1/1917 Langerman
1,226,640 A 5/1917 Charles
1,255,497 A 2/1918 Ankele
1,479,707 A 1/1924 Foisy
1,582,813 A 4/1926 Ballin
1,692,200 A 11/1928 Capuano
1,886,718 A 11/1932 Noel
1,887,780 A 11/1932 Noel
1,970,110 A 8/1934 Vaccaro
2,025,357 A 12/1935 Pagan
2,129,196 A 9/1938 Boshnack et al.
2,251,576 A 8/1941 Puodis
2,262,402 A 11/1941 Oppenheimer
2,263,546 A 11/1941 Goldsmith et al.
2,283,362 A 5/1942 Hamilton
2,323,390 A 7/1943 Friedman
2,385,178 A * 9/1945 Abzug ..... 2/237
2,389,697 A * 11/1945 Stoeckert ..... 2/247
2,458,353 A 1/1949 Decker
2,472,286 A 6/1949 Drasnin
2,489,148 A 11/1949 Ludwig
2,489,868 A 11/1949 Dowling et al.
2,527,224 A 10/1950 Landy
2,530,453 A 11/1950 Eagle
2,557,445 A 6/1951 Lewallen
2,593,795 A 4/1952 Rhoads et al.
2,604,627 A 7/1952 Abbott
2,671,902 A 3/1954 Grue
2,680,851 A * 6/1954 Vallone ..... 2/234
2,705,326 A 4/1955 Lahnstein et al.
2,721,330 A * 10/1955 Axler ..... 2/237
2,732,560 A 1/1956 Frederiksen, Sr.
2,810,132 A 10/1957 Nicholson
2,899,684 A 8/1959 Riley
2,970,598 A * 2/1961 Backlar ..... 450/95
3,000,012 A 9/1961 Neil
3,010,111 A 11/1961 Ralph
3,072,917 A 1/1963 Watson, Jr.
3,077,604 A 2/1963 Colangelo
3,137,866 A 6/1964 Stephens, Jr.
3,212,689 A 10/1965 Woolfolk
3,220,017 A 11/1965 Morton
3,310,053 A 3/1967 Greenwood
3,374,508 A 3/1968 Slimovitz
3,430,265 A 3/1969 Mazza
3,537,108 A 11/1970 Daniels
3,559,212 A 2/1971 Skovron
3,593,803 A 7/1971 Ibach
3,611,444 A 10/1971 Rector
3,627,181 A 12/1971 Bianchi
3,723,994 A 4/1973 Tucker
3,751,731 A 8/1973 Bennett
3,782,614 A 1/1974 Campisi
3,812,541 A * 5/1974 Stuart ..... 2/237
4,035,844 A 7/1977 Atack et al.
4,051,553 A 10/1977 Howard
4,077,067 A 3/1978 Kozdal
4,123,804 A 11/1978 Michael et al.
4,138,745 A 2/1979 Greenspan
4,149,275 A 4/1979 Sanchez
4,156,295 A 5/1979 LeRoy
4,164,044 A * 8/1979 Holmes ..... 2/237
4,200,938 A 5/1980 LeTourneau
4,235,356 A 11/1980 Atchisson
4,247,097 A 1/1981 Schwartz
4,262,832 A 4/1981 Perkins
4,318,503 A 3/1982 Capano
4,334,326 A 6/1982 Mallow
4,386,642 A 6/1983 Durbin
4,389,801 A 6/1983 Sharrock et al.
4,463,847 A 8/1984 Gordon
4,532,656 A 8/1985 Suzuki
4,541,556 A 9/1985 Collins et al.
4,602,390 A 7/1986 Morera et al.
4,615,049 A 10/1986 Samelian
4,637,075 A 1/1987 Ingrisano et al.
4,651,355 A 3/1987 White
4,672,721 A 6/1987 Provost
4,675,914 A 6/1987 Mitchell
4,704,743 A 11/1987 Thornell et al.
4,710,979 A 12/1987 Bull et al.
4,741,465 A 5/1988 Johnson
4,791,681 A 12/1988 Dean
4,796,306 A 1/1989 Mitchell
4,827,535 A 5/1989 Socey
4,843,649 A 7/1989 Jewell et al.
4,846,383 A 7/1989 Gallagher
4,867,246 A 9/1989 Kiger
4,877,131 A 10/1989 Patros et al.
4,882,786 A 11/1989 Gross
4,898,310 A 2/1990 Remington
4,899,395 A 2/1990 Spector
4,966,320 A 10/1990 DeSantis et al.
4,966,321 A 10/1990 Outlaw
4,989,273 A 2/1991 Cromartie
4,995,119 A 2/1991 Codkind
4,998,654 A 3/1991 Bruzek et al.
5,022,094 A 6/1991 Hames et al.
5,035,003 A 7/1991 Rinehart
5,054,127 A 10/1991 Zevchak
5,054,671 A 10/1991 Else
5,067,178 A 11/1991 Katchka
5,082,157 A 1/1992 Emerson-Santos
5,127,565 A 7/1992 Grant
5,152,442 A 10/1992 Gallagher
5,172,683 A 12/1992 West
5,215,238 A 6/1993 Baruch
5,221,031 A 6/1993 Prigmore
5,285,312 A 2/1994 Mastro
5,294,031 A 3/1994 Volpei et al.
5,374,919 A * 12/1994 Zelka et al. ..... 340/574
5,397,040 A 3/1995 Lee
5,400,438 A 3/1995 Staff et al.
5,419,474 A 5/1995 Marx et al.
5,421,032 A 6/1995 Murphy
5,431,318 A * 7/1995 Garcia ..... 224/192
5,444,874 A 8/1995 Samelian et al.
5,445,303 A 8/1995 Cawile, Jr.
5,451,725 A 9/1995 Goldman
5,453,064 A 9/1995 Williams, Jr.
5,460,188 A 10/1995 Barrett, Sr.
5,476,439 A 12/1995 Robinson
5,495,967 A 3/1996 Parton
5,511,247 A 4/1996 Block
5,517,693 A 5/1996 Noonan
5,517,696 A 5/1996 Krugler
5,535,453 A 7/1996 Howard
5,539,932 A 7/1996 Howard
5,542,122 A 8/1996 Moldovan
5,555,566 A 9/1996 Kuhn
5,573,441 A 11/1996 Smith
5,584,424 A 12/1996 Stava
5,588,154 A 12/1996 Blauer et al.
5,598,586 A * 2/1997 Munjone ..... 2/237
5,638,549 A 6/1997 Thomas
5,662,219 A 9/1997 Tschudy et al.
5,666,667 A 9/1997 Hook, Jr.
5,692,237 A 12/1997 Bennett
5,706,521 A 1/1998 Haney
5,708,978 A 1/1998 Johnsrud
5,749,098 A 5/1998 Evans
5,771,496 A 6/1998 Wood
5,800,900 A 9/1998 Mitchell
5,809,576 A 9/1998 Huston et al.
5,819,312 A 10/1998 Snyder et al.
5,829,653 A 11/1998 Kaiser
5,832,536 A 11/1998 Kramer
5,832,540 A 11/1998 Knight
5,864,884 A 2/1999 Salvitti
5,881,385 A 3/1999 Hochmuth
5,884,338 A 3/1999 Golde
5,894,976 A * 4/1999 Harper ..... 224/587

(56) References Cited

U.S. PATENT DOCUMENTS

| | | | | |
|---|---|---|---|---|
| 5,901,372 | A | 5/1999 | Lawler | |
| 5,909,834 | A | 6/1999 | Parrott, III | |
| 5,924,565 | A | 7/1999 | Colee | |
| 5,931,358 | A | 8/1999 | Rogers | |
| 5,940,883 | A | 8/1999 | Daoust | |
| 5,953,757 | A | 9/1999 | Blanks, I | |
| 5,991,925 | A | 11/1999 | Wu | |
| 6,010,473 | A | 1/2000 | Robinson | |
| 6,014,774 | A | 1/2000 | Davey et al. | |
| 6,076,715 | A | 6/2000 | Easter | |
| 6,079,049 | A | 6/2000 | Moir | |
| 6,082,600 | A | 7/2000 | Angus et al. | |
| 6,105,170 | A | 8/2000 | Lisciandro et al. | |
| 6,131,198 | A | 10/2000 | Westrick | |
| 6,154,888 | A | 12/2000 | Krohn | |
| 6,176,407 | B1 | 1/2001 | Jones et al. | |
| 6,199,218 | B1 | 3/2001 | Michael | |
| 6,244,400 | B1 | 6/2001 | Bowers | |
| 6,264,079 | B1 | 7/2001 | Skaggs | |
| 6,286,736 | B1 | 9/2001 | Angus et al. | |
| 6,289,517 | B1 | 9/2001 | Minkow et al. | |
| 6,318,613 | B1 | 11/2001 | Underhill | |
| 6,374,421 | B1 | 4/2002 | Cleary | |
| 6,477,710 | B1 | 11/2002 | Ojoyeyi | |
| 6,547,070 | B1 | 4/2003 | Kolpin | |
| 6,547,111 | B2 | 4/2003 | French | |
| 6,553,574 | B1 | 4/2003 | Hall et al. | |
| 6,671,887 | B1 | 1/2004 | Eligan et al. | |
| 6,678,986 | B2 | 1/2004 | Roush | |
| 6,681,402 | B1 | 1/2004 | Bevier et al. | |
| 6,685,066 | B2 | 2/2004 | Cragg | |
| 6,760,922 | B1 | 7/2004 | Morales | |
| 6,763,527 | B1 | 7/2004 | Rivoli et al. | |
| 6,769,139 | B1 | 8/2004 | Goldkind | |
| 6,820,281 | B2 | 11/2004 | Mariland et al. | |
| 6,874,618 | B1 | 4/2005 | Cragg | |
| 6,926,182 | B2 | 8/2005 | Cragg | |
| 6,978,484 | B2 | 12/2005 | Donlan et al. | |
| 6,981,283 | B2 | 1/2006 | Kujawski | |
| 6,986,164 | B1 | 1/2006 | Morales | |
| 6,990,689 | B1 | 1/2006 | Thellmann | |
| 7,000,259 | B2 | 2/2006 | Matechen | |
| 7,003,810 | B2 | 2/2006 | Goldkind | |
| 7,058,987 | B2 | 6/2006 | Salazar | |
| 7,152,247 | B2 | 12/2006 | Parsons | |
| 7,152,248 | B2 | 12/2006 | Ziemer | |
| 7,216,404 | B1 | 5/2007 | Doyle | |
| 7,571,495 | B2 | 8/2009 | Emeth | |
| 7,631,368 | B1 | 12/2009 | Samson | |
| 7,636,949 | B1 | 12/2009 | Shooshan | |
| 7,636,952 | B2 | 12/2009 | Fordham et al. | |
| 7,637,218 | B1 | 12/2009 | Burton | |
| 7,644,448 | B2 | 1/2010 | Grilliot et al. | |
| 7,681,255 | B2 | 3/2010 | Morales et al. | |
| 7,712,153 | B2 | 5/2010 | Adams, Jr. | |
| 7,743,430 | B2 | 6/2010 | Jennings et al. | |
| 7,753,759 | B2 | 7/2010 | Pintor et al. | |
| 7,823,221 | B2 | 11/2010 | Green | |
| 7,918,371 | B2 | 4/2011 | Wilson | |
| 7,926,123 | B2 * | 4/2011 | Walburg | 2/227 |
| 8,060,948 | B2 | 11/2011 | Pesic | |
| 8,302,827 | B1 | 11/2012 | Cole | |
| 8,307,465 | B2 | 11/2012 | French et al. | |
| 8,332,967 | B2 * | 12/2012 | Echikson | 2/250 |
| 8,448,264 | B2 * | 5/2013 | Ellsworth | 2/96 |
| 8,484,765 | B2 * | 7/2013 | French | 2/250 |
| 8,522,367 | B2 * | 9/2013 | French et al. | 2/250 |
| 2001/0032347 | A1 | 10/2001 | Redwood et al. | |
| 2002/0138895 | A1 * | 10/2002 | Tajima et al. | 2/237 |
| 2003/0182714 | A1 | 10/2003 | Mariland et al. | |
| 2003/0205595 | A1 | 11/2003 | Young | |
| 2004/0244090 | A1 | 12/2004 | Langer | |
| 2005/0015844 | A1 | 1/2005 | Parsons | |
| 2005/0017034 | A1 | 1/2005 | Ausanio | |
| 2005/0022289 | A1 | 2/2005 | Platt | |
| 2005/0066424 | A1 | 3/2005 | Salazar | |
| 2005/0198872 | A1 | 9/2005 | Correa | |
| 2005/0223466 | A1 | 10/2005 | Jennings et al. | |
| 2005/0235398 | A1 | 10/2005 | Yoo | |
| 2006/0015987 | A1 | 1/2006 | Anderson | |
| 2007/0000965 | A1 | 1/2007 | Cannon, Jr. | |
| 2007/0245444 | A1 | 10/2007 | Brink | |
| 2007/0250980 | A1 | 11/2007 | Pellerin | |
| 2007/0254129 | A1 | 11/2007 | Horblitt | |
| 2008/0006659 | A1 | 1/2008 | Cain | |
| 2008/0125842 | A1 | 5/2008 | Petitt | |
| 2008/0163407 | A1 | 7/2008 | Gardner | |
| 2008/0184459 | A1 | 8/2008 | Barnes | |
| 2008/0216212 | A1 | 9/2008 | Burgess et al. | |
| 2008/0263742 | A1 | 10/2008 | Vaughn | |
| 2008/0289082 | A1 * | 11/2008 | Harris | 2/251 |
| 2009/0025117 | A1 | 1/2009 | French | |
| 2009/0172861 | A1 | 7/2009 | Tomlinson et al. | |
| 2009/0199319 | A1 | 8/2009 | Jenkin | |
| 2009/0222974 | A1 * | 9/2009 | Walburg | 2/234 |
| 2009/0265835 | A1 | 10/2009 | French et al. | |
| 2009/0293170 | A1 | 12/2009 | Kiker | |
| 2010/0017943 | A1 | 1/2010 | Morales et al. | |
| 2010/0050312 | A1 | 3/2010 | French et al. | |
| 2010/0299802 | A1 | 12/2010 | Bailey et al. | |
| 2010/0319108 | A1 | 12/2010 | King | |
| 2011/0030126 | A1 | 2/2011 | French | |
| 2011/0041231 | A1 | 2/2011 | Behrens et al. | |
| 2011/0119800 | A1 | 5/2011 | Garrido et al. | |

* cited by examiner

GARMENT POCKET FOR CARRYING AN OBJECT IN A CONCEALED STATE

CROSS-REFERENCE TO RELATED APPLICATIONS

This application is a divisional of U.S. application Ser. No. 12/242,082, filed Sep. 30, 2008, which claims the benefit of U.S. Provisional Application No. 61/048,043, filed Apr. 25, 2008, both of which applications are incorporated by reference into this Application.

BACKGROUND OF THE INVENTION

The present invention is directed to garment pocket and, more specifically, to a garment pocket for carrying, in a concealed and readily-accessible state, a handgun or other object.

Law-enforcement personnel are usually authorized to carry protection devices, e.g., handgun, stun gun, pepper spray, etc. However, when working undercover or on duty in plain clothes, law-enforcement personnel can have a problem with telegraphing, which is sometimes referred to as "gun profiling" or "mapping." "Telegraphing" is the tendency for a concealed handgun or other object to show through the concealing garment, rendering it readily detectable by others. Holsters and other known carrying devices worn by law-enforcement personnel do not sufficiently minimize telegraphing. Furthermore, when the law-enforcement officer or wearer is wearing only one or two layers of clothing, such as when the wearer is dressed appropriately for warm weather or for working indoors in a temperature-controlled environment, the presence of the carrying device becomes even more evident. In many instances, the carrying device, itself, will telegraph the potential presence of a handgun or other object. One way to attempt to avoid this particular problem is to carry the handgun (or other object) in a front pocket of the person's pants, thus foregoing the use of the carrying device altogether. This practice, however, has at least several disadvantages. First, the pocket is usually insufficient in size to store and conceal most sizes of handguns, including standard size (also known as "full size"), compact size, and even subcompact size (also known as "pocket pistol"). Second, telegraphing of the handgun or other object is not minimized because the object is commonly carried in the pocket such that a protuberance is present that is not sufficiently concealed by the person's pants. Third, the object is commonly carried in the pocket such that the person's ability to kneel, run, and sit are restricted. Fourth, the person's ability to quickly remove the object from the pocket is compromised because the size of the person's hand gripping the object is usually greater than the size of the pocket opening.

Accordingly, what is needed is a solution to the foregoing problems. More specifically, there is a need for a pocket that is especially suitable for carrying, in a concealed and readily-accessible state, a handgun or other object.

SUMMARY OF THE INVENTION

In accordance with one aspect of the present invention, a pocket for a garment is disclosed. The pocket comprises a first layer and a second layer, which is attached to the first layer to form a partially enclosed space. The partially enclosed space comprises a region defined by (1) a first line corresponding substantially to a line of flexion of a hip joint of a wearer of the garment and (2) a second line corresponding substantially to a centerline of a thigh of a wearer of the garment. The region is configured and disposed to substantially conceal an object stored in the region from a person viewing the garment.

In accordance with another aspect of the present invention, a garment for a person is disclosed. The garment comprises a pocket, which comprises a first layer and a second layer. The second layer is attached to the first layer to form a partially enclosed space. The partially enclosed space comprises a region defined by (1) a first line corresponding substantially to a line of flexion of a hip joint of a wearer of the garment and (2) a second line corresponding substantially to a centerline of a thigh of a wearer of the garment. The first layer and the second layer are configured and disposed to form an opening to provide access to the space. The opening is configured to be adjustable from a first size to a second size, the second size of the opening being larger than the first size of the opening.

In accordance with yet another aspect of the present invention, a method of making a garment for a person is disclosed. The method comprises the following: (1) providing at least one layer of material; (2) forming a pocket having an opening from the at least one layer of material, the pocket comprising a region defined by a first line corresponding to a line of flexion corresponding to a hip joint of a wearer of the garment and by a second line corresponding to a centerline of a thigh of the wearer of the garment, the region being configured and disposed to substantially conceal an object disposed in the region from a person viewing the garment; (3) attaching a first part of a fastener to the at least one layer of material proximate to the opening of the pocket; (4) attaching a second part of a fastener to the pocket opposite the first part of a fastener; (5) engaging the first part of a fastener and the second part of a fastener to provide a reduction in the size of the opening of the pocket; (6) connecting the first layer and the second layer with a first seam, the first seam being configured and disposed to orient the object in the region; (7) connecting the first layer and the second layer with a second seam, the second seam intersecting the first seam and being configured and disposed to guide the object into the region; and (8) attaching the pocket to the garment.

In accordance with still yet another aspect of the present invention, a system for carrying a handgun in a garment is disclosed. The system comprises a pocket to be attached to a garment. The pocket comprises at least one sheet of material configured to form a partially enclosed space, the partially enclosed space comprising a region to store a handgun. The region is defined by (1) a first line corresponding substantially to a line of flexion of a hip joint of a wearer of the garment and (2) a second line corresponding substantially to a centerline of a thigh of a wearer of the garment. The pocket further comprises (1) an inner edge to be disposed proximate to an inseam of the garment; (2) a base intersecting the inner edge; and (3) a seam disposed adjacent to the region, the seam extending substantially parallel to the inner edge for a predetermined distance. The inner edge, the base and the seam define a zone in the region to receive a portion of a handgun. The zone is configured to (1) position a barrel of the handgun adjacent to the inner edge; (2) position a muzzle of the handgun substantially adjacent to the base; and (3) position a trigger guard of the handgun proximate to an end of the seam opposite the base. The seam and the inner edge are configured and disposed to restrict lateral movement of the handgun when positioned in the zone.

Among the advantages of the present invention are that it enables the wearer to carry, in a concealed and readily-accessible state, a handgun or other object. The present invention minimizes telegraphing of the handgun or other object and also renders it extremely difficult for a person other than the wearer to access the handgun or other object carried therein without the wearer's knowledge. Additionally, it is difficult for the wearer to lose possession of the handgun or other object carried therein, including even while the wearer is engaging in strenuous physical activity (e.g., fighting, running, jumping). The present invention does not significantly compromise the wearer's freedom of movement because the handgun or other object does not intersect (1) the line of flexion of the wearer's hip joint or (2) the line of flexion of the wearer's knee joint. For example, the ability of the wearer to kneel, run, and sit is not significantly compromised. The wearer also benefits from having "constant recognition" or "constant feel" that the handgun or other object is on his person because it is carried adjacent to his inner thigh, increasing the possibility that the wearer would notice if it went missing.

Other features and advantages of the present invention will be apparent from the following more detailed description of the corresponding embodiments, taken in conjunction with the accompanying drawings which illustrate, by way of example, the principles of the invention.

BRIEF DESCRIPTION OF THE DRAWINGS

Wherever possible, the same reference numbers are used throughout the drawings to refer to the same or like parts.

DETAILED DESCRIPTION OF THE INVENTION

Figure 1:
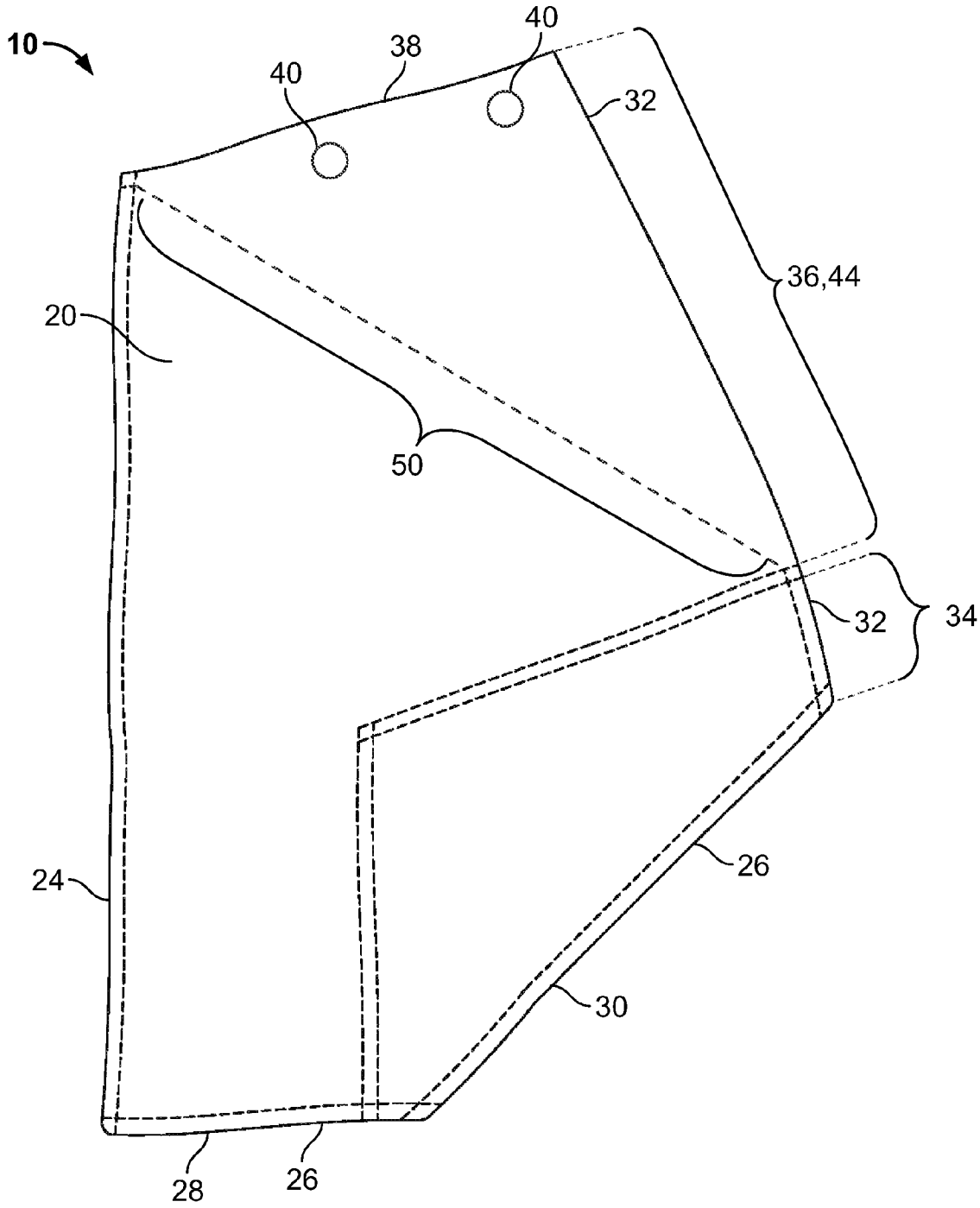
FIG. 1 is a schematic front plan view of an exemplary embodiment of a pocket in accordance with the present invention.

FIG. 1 is a schematic front plan view of an exemplary embodiment of a pocket in accordance with the present invention. Pocket 10, which is configured for a left-handed user, is intended for incorporation into a garment (e.g., pants, shorts). By way of example, pocket 10 may be used as the left front pocket of a conventional pair of pants. It is to be understood that pocket 10 actually includes two layers of material to form the pocket. More specifically, pocket 10 includes an outer layer of material (outer layer 20) and an inner layer of material (see, e.g., FIG. 5 at 136). Only outer layer 20 is shown in FIG. 1 because outer layer 20 and the corresponding inner layer are substantially congruent. Outer layer 20 and the corresponding inner layer each may be formed from a single piece of pliable material. The pliable materials that can be used include (without limitation) ripstop cloth and ripstop nylon. Outer layer 20 is fastened (e.g., seamed or sewn) to the corresponding inner layer along inner edge 24; first and second segments 28, 30 of base edge 26; and segment 34 of outer edge 32. Alternatively, outer layer 20 and the corresponding inner layer may be from a single piece of pliable material with only minimal fastening being required. For example, a substantially symmetrical piece of pliable material may be folded over upon itself along inner edge 24. In such an instance, outer layer 20 still is fastened to the corresponding inner layer along base edge 26 and segment 34 of outer edge 32.

In pocket 10, the corresponding inner layer (but not outer layer 20) can be fastened to the waistline of the garment along top or first edge 38. As used herein, "waistline" is defined as the part of a garment that generally covers the waistline of the person and/or an adjoining area above or below the waistline. Similarly, the corresponding inner layer (but not outer layer 20) is intended to be fastened to the garment along segment 36 of outer or fourth edge 32, which coincides with the typical pocket opening 44 (explained below). Both outer layer 20 and the corresponding inner layer are intended to be fastened to the garment along segment 34 of outer edge 32. Outer edge 32 can be extended to provide for segment 34 to maintain pocket 10 in a proper position following incorporation into the garment, especially as pocket 10 is not fastened to the garment along inner or second edge 24 or base or third edge 26. Additionally, in pocket 10, outer layer 20 is releasably fastened to the corresponding inner layer along waist edge 38 via readily-releasable fasteners 40 (that are disguised or hidden within a flap in the garment that also serves as a waistband). As shown in FIG. 1, readily-releasable fasteners 40 are snaps; however, other readily-releasable fasteners, including (without limitation) hook and loop-type fasteners (e.g., Velcro®) may be used instead of, or in combination with, snaps. In another embodiment, outer layer 20 can be releasably fastened to the corresponding inner layer along outer edge 32. See e.g., FIG. 7.

In FIG. 1, the pocket 10 is shown with an unenlarged pocket opening 44, which opening is comparable in size to a conventional pocket opening. The wearer can freely insert his hand into pocket 10 by way of unenlarged pocket opening 44 and grip an exemplary object (e.g., handgun) carried therein. However, the wearer cannot readily remove the exemplary object from pocket 10 by way of unenlarged pocket opening 44 because, when gripping the exemplary object, the size of his hand is greater than the size of unenlarged pocket opening 44. Upon the release of readily-releasable fasteners 40, the opening of pocket 10 becomes enlarged pocket opening 50, which is shown in phantom in FIG. 1. Enlarged pocket opening 50 is significantly larger than a conventional pocket opening. Enlarged pocket opening 50 is dimensioned such that the wearer can readily remove the exemplary object from pocket 10 because the size of the enlarged pocket opening is greater than the size of the wearer's hand gripping the object.

Figure 2:
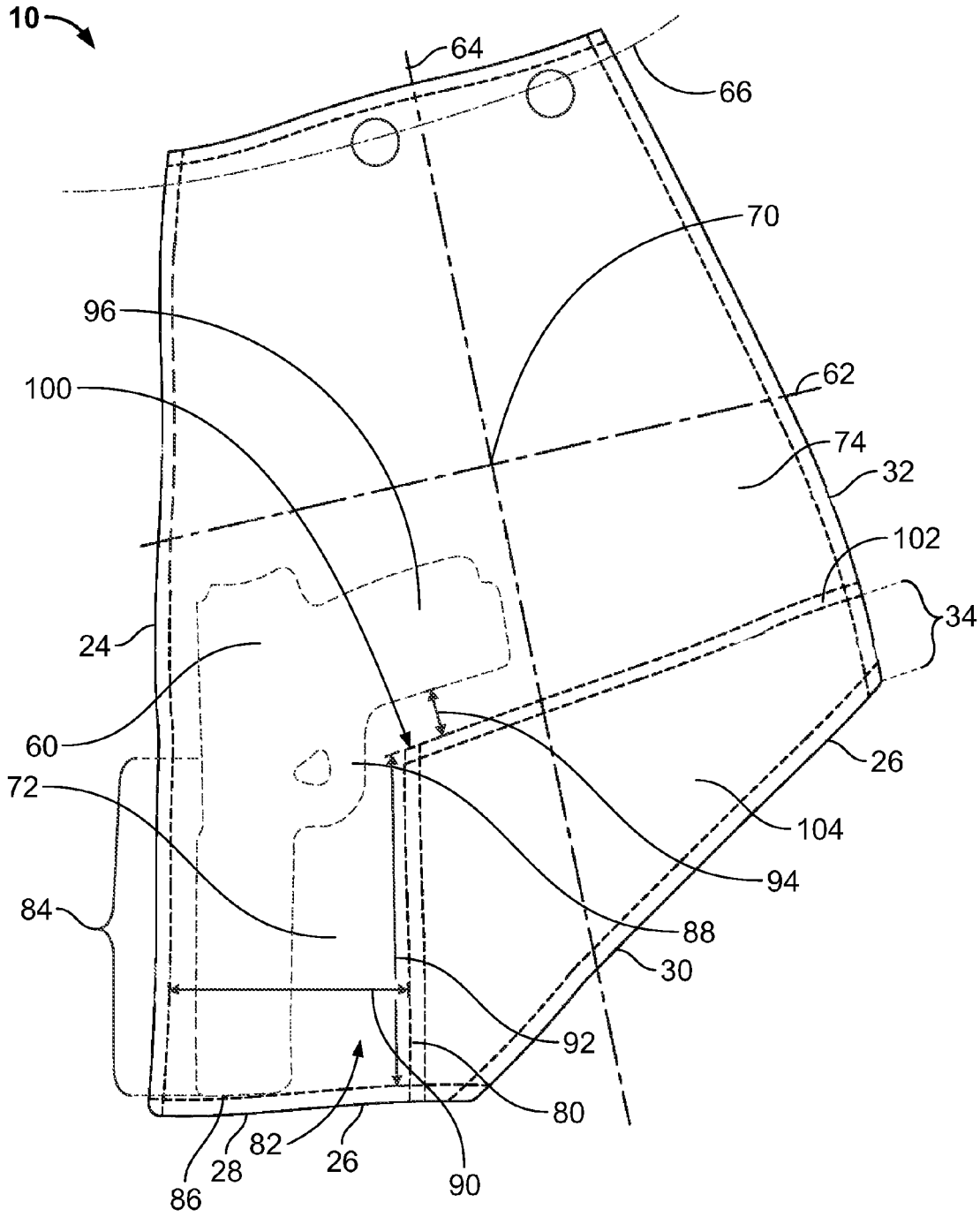
FIG. 2 is a schematic front plan view of the pocket of FIG. 1 showing a handgun therein.

FIG. 2 is a schematic front plan view of pocket 10 showing a handgun 60 to be carried therein. Pocket 10 is incorporated into a garment (e.g., pants) such that it is oriented as shown in FIG. 2. Line 62 through pocket 10 represents approximately the line of flexion corresponding to the wearer's hip joint. Line 64 through pocket 10 represents approximately the centerline of the wearer's thigh. Line 66 through pocket 10 represents approximately the wearer's waistline. Origin point 70 is defined by the intersection of line 62 and line 64.

Assuming that line 62 and line 64 correspond respectively to the x-axis and y-axis of a Cartesian coordinate system, pocket 10 can be considered as having four quadrant-like regions. First region 72 is defined by (1) the line of flexion corresponding to the wearer's hip joint (i.e., line 62); (2) the centerline of the wearer's thigh (i.e., line 64); (3) inner edge 24 of pocket 10, which corresponds approximately to the line defined by the wearer's inseam; and (4) base edge 26, which is located above the line of flexion corresponding to the wearer's knee joint, and includes first segment 28.

Second region 74 is defined by (1) the line of flexion corresponding to the wearer's hip joint (i.e., line 62); (2) the centerline of the wearer's thigh (i.e., line 64); (3) outer edge 32; and (4) second segment 30 of base edge 26. Handgun 60 is shown as being carried in first region 72 of pocket 10, significantly decreasing the possibility that an observer will notice that the wearer is carrying a handgun.

Pocket 10 includes various features for maintaining handgun 60 in the orientation shown in FIG. 2. More specifically, pocket 10 includes first seam 80, which is substantially parallel to inner edge 24 and is substantially perpendicular to segment 28 of base edge 26. First seam 80, inner edge 24, and first segment 28 define receiving zone 82, which is configured to receive barrel portion 84, muzzle 86, and trigger guard 88 of handgun 60. Receiving zone 82 is dimensioned to aid in maintaining handgun 60 in first region 72 and to provide an ergonomic orientation of handgun 60. Ergonomic orientation refers to one or more of (1) barrel portion 84 being substantially adjacent to inner edge 24; (2) muzzle 86 being substantially adjacent to first segment 28 of base edge 26; and/or (3) trigger guard 88 being proximal to the end of first seam 80 opposite base edge 26 (i.e., first end 100). Width 90 of receiving zone 82 is defined by the approximate distance between inner edge 24 and first seam 80. First seam 80 prevents movement of trigger guard 88 away from inner edge 24 to prevent handgun 60 (or a portion thereof) from entering second region 74. First seam 80 and inner edge 24 restrict lateral movement of handgun 60, maintaining barrel portion 84 in an orientation substantially adjacent to inner edge 24. If width 90 is too great, barrel portion 84 can move and not maintain such adjacent orientation. Conversely, if width 90 is too small, the wearer may experience difficulty in inserting barrel portion 84 and trigger guard 88 into receiving zone 82.

Figure 4:
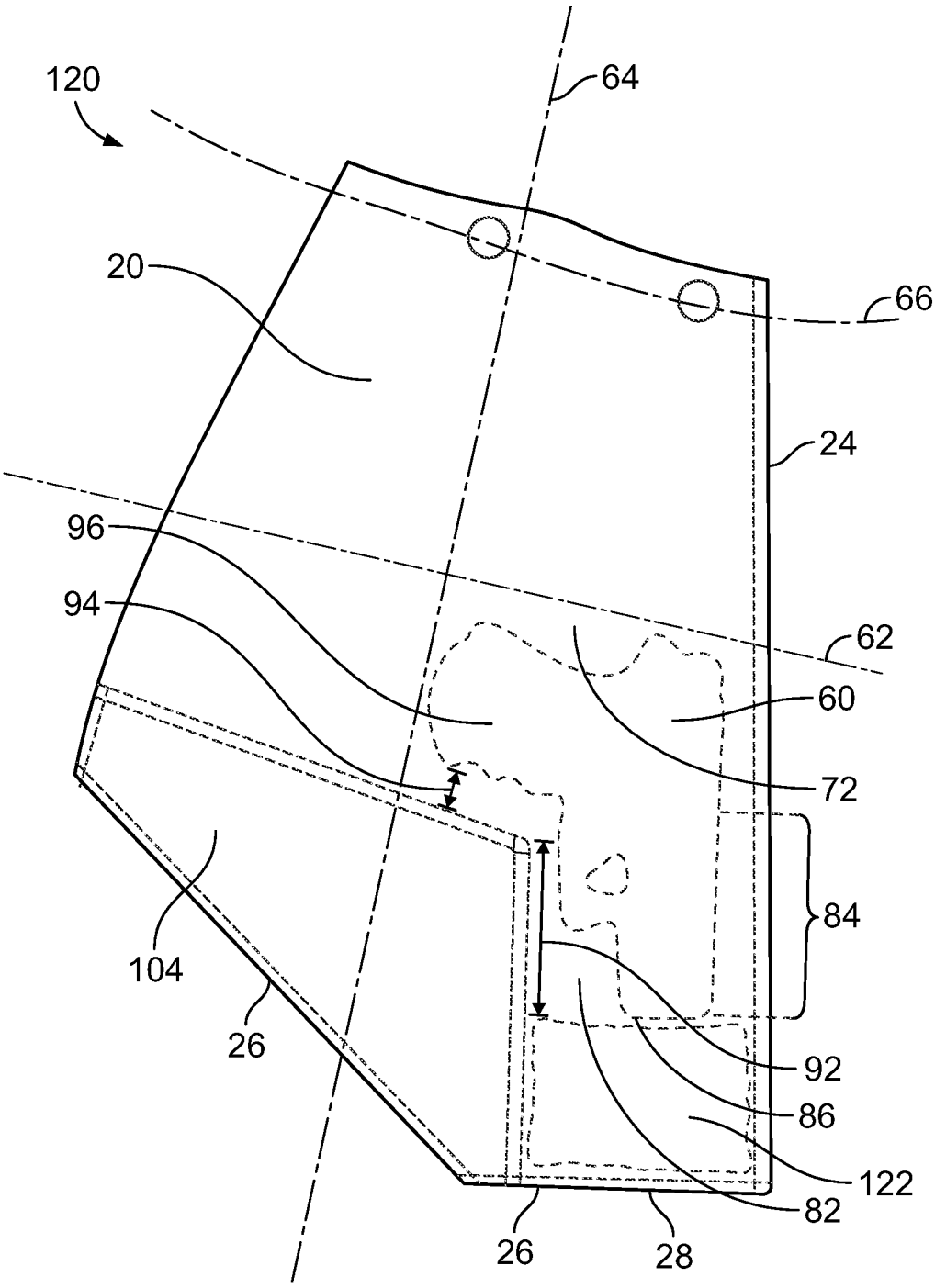
FIG. 4 is a schematic front plan view of another exemplary embodiment of the pocket of the present invention showing a handgun being carried therein.

Height 92 of receiving zone 82 is defined by the approximate length of first seam 80, unless a removable spacer (see FIG. 4 at 122) is placed in the bottom portion of receiving zone 82. (In such an instance, height 92 of receiving zone 82 is defined as the approximate length of first seam 80 from first end 100 to removable spacer 122.) As shown in FIG. 2, the length of first seam 80 can be selected such that, once handgun 60 is inserted into receiving zone 82, the muzzle 86 of handgun 60 rests on base edge 26 (or removable spacer 122) and forms a finger gap 94 between grip 96 of handgun 60 and first end 100 of first seam 80. Finger gap 94 enables the wearer to grip and remove handgun 60 from pocket 10 more readily. The wearer, in preparing to remove handgun 60 from pocket 10, does not have to force his fingers between grip 96 and first end 100 of first seam 80 in order to grasp grip 96. Accordingly, finger gap 94 and the length of barrel portion 84 of handgun 60 are factors in selecting the length of first seam 80. As shown in FIG. 4, height 92 of receiving zone 82 can be decreased by placing a removable spacer 122 in the bottom portion of receiving zone 82. The use of removable spacer 122 allows pocket 10 to accommodate a handgun having a shorter barrel portion, while still providing for finger gap 94. Thus, pocket 10 can be used to carry handguns of varying barrel length, unlike many holsters and many other conventional carrying apparatuses, which are manufactured for one specific handgun only.

In another embodiment, pocket 10 could be modified to carry a handgun having a longer barrel portion by extending inner edge 24, first seam 80, and base edge 26 downward (i.e., in the direction of the wearer's knee), increasing height 92 of receiving zone 82. However, it is preferable that neither inner edge 24, first seam 80, nor base edge 26 is extended so far downward that they meet or intersect the line of flexion of corresponding to the wearer's knee joint, as this would adversely affect the wearer's mobility when carrying the handgun. For example, the wearer's ability to kneel, run, or sit could be compromised. Additionally, the possibility of telegraphing of the handgun would be present.

Pocket 10 also includes second seam 102, which meets first end 100 of first seam 80 and segment 34 of outer edge 32. Second seam 102 can be provided to seal off adjoining zone 104, which includes part of first region 72 and part of second region 74. The second seam 102 can be configured to aid the wearer in correctly inserting barrel portion 84 of handgun 60 into receiving zone 82 by preventing the wearer from mistakenly inserting handgun 60 into adjoining zone 104.

Figure 3:
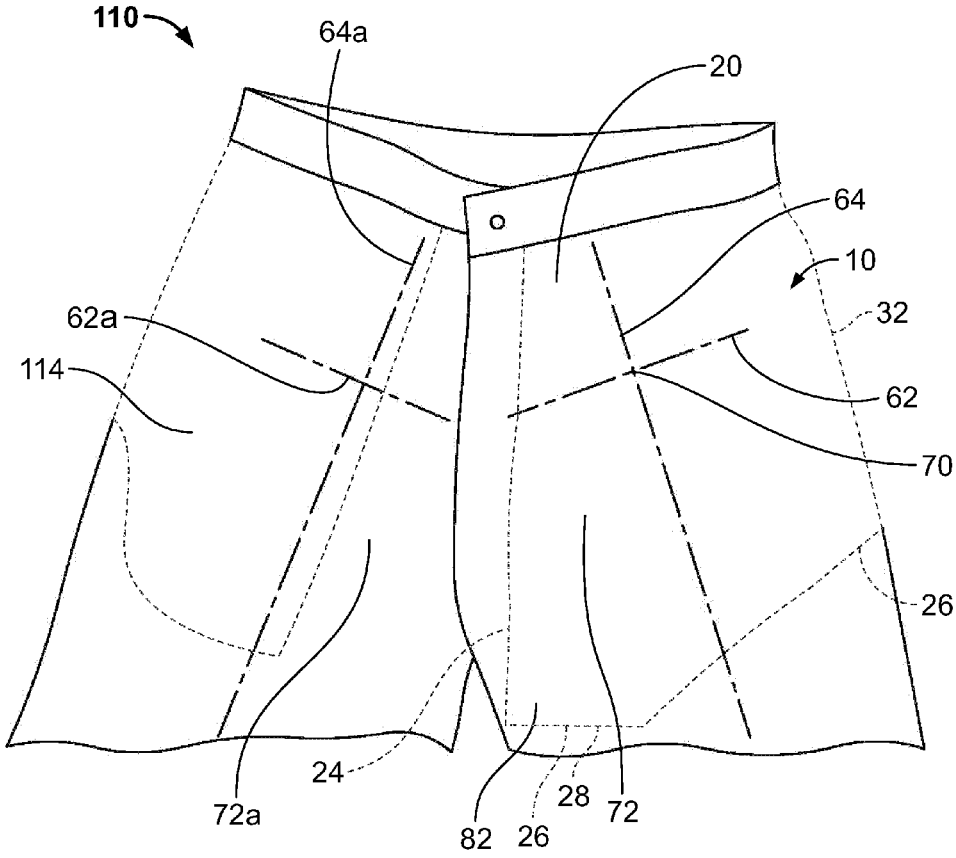
FIG. 3 is a partial front view of a conventional pair of pants showing the pocket of FIG. 1.

FIG. 3 is a partial front view of a conventional pair of pants 110 having pocket 10 incorporated therein. Specifically, pocket 10 has been substituted for the left front pocket of pants 110. An approximate outline of pocket 10 is shown in phantom, because pocket 10, in its first state (i.e., its unenlarged state), is not visible when viewing pants 110. As shown in FIG. 3, the inner edge 24 of the pocket 10 is positioned near a fly area or fly front of the pants 110. For purposes of comparison, FIG. 3 includes an approximate outline of a conventional right front pocket 114. As suggested by FIG. 3, even a relatively large conventional front pocket, such as right front pocket 114, does not allow for a handgun (or other object) to be carried in first region 72*a*, which is the counterpart to first region 72 of pocket 10. Telegraphing of a handgun carried in conventional right front pocket 114 is likely because, inter alia, the handgun would intersect the centerline of the wearer's thigh, which is represented approximately by line 64*a* (the counterpart to line 64). Additionally, there is a significant possibility that a handgun carried in conventional right front pocket 114 would intersect the line of flexion corresponding to the wearer's hip joint, which is represented approximately by line 62*a* (the counterpart to line 62). As discussed previously, such intersection by the handgun of lines 62*a* and/or 64*a* would compromise movement by the wearer and would increase the probability of telegraphing the handgun. In further contrast to pocket 10, conventional right front pocket 114 does not include any features for maintaining a handgun in a position and in an orientation that facilitates the removal of the handgun by the wearer. Conventional right front pocket 114 also does not include an enlargeable pocket opening to facilitate removal of a handgun by the wearer.

FIG. 4 is a schematic front plan view of another exemplary embodiment of the present invention having a handgun being carried therein. Pocket 120 is configured for a right-handed wearer and is intended to be substituted for the right front pocket of a conventional pair of pants. A handgun 60 having a relatively short barrel portion 84 is shown being carried therein, specifically within first region 72. Removable spacer 122 (shown in phantom) is present in the bottom portion of the receiving zone 82 and limits the distance muzzle 86 can travel in receiving zone 82. As discussed previously, removable spacer 122 reduces the (effective) height 92 of receiving zone 82, thus providing for finger gap 94 when a handgun 60 having a relatively short barrel portion 84 is being carried in the pocket. Removable spacer 122 can be a foam insert, one or more pins attached to inner and outer layers (e.g., safety pin), buttons, hook and loop-type fasteners (e.g., Velcro®), or any other suitable means that can reduce the height of receiving zone 82.

Figure 5:
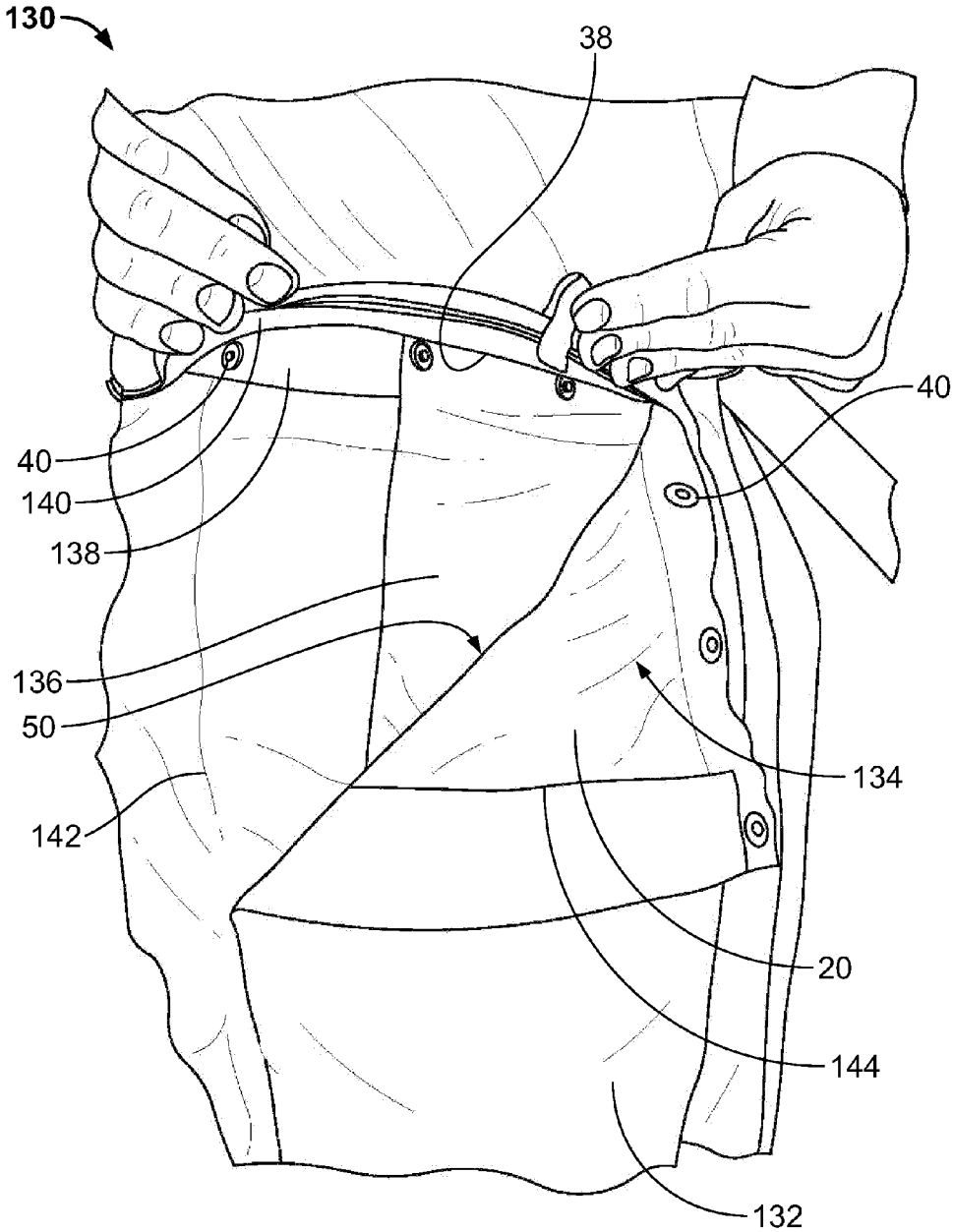
FIG. 5 is a side view of a wearer wearing a conventional pair of pants showing an exemplary embodiment of the pocket of the present invention in an enlarged position.

FIG. 5 is a side view of wearer 130 wearing pants 132 having another exemplary embodiment of the pocket of the present invention incorporated therein. The opening of pocket 134 is shown in its second state (i.e., enlarged state), as readily-releasable fasteners 40 are not fastened. As stated earlier, enlarged pocket opening 50 is dimensioned such that wearer 130 can readily remove an exemplary object (e.g., handgun) from pocket 134 even though the size of his hand is greater when gripping such object. FIG. 5 also shows the relationship between inner layer 136 and outer layer 20. Where possible, pre-existing seams of pants 132 are used to incorporate pocket 134, to minimize the possibility that an observer will notice that pants 132 have been modified. For example, waist edge 38 of inner layer 136 is fastened (e.g., seamed) along waistline 138 of pants 132, beneath beltline 140. When fastened, fasteners 40 are concealed by beltline 140, hiding the presence of a pocket opening that is enlargeable (see enlarged pocket opening 50). Additionally, there is no rigid requirement that inner layer 136 and outer layer 20 be congruent. As shown in FIG. 5, side edge 144 of outer layer 20 extends further toward side seam 142 of pants 132 than does inner layer 136.

Figure 6A:
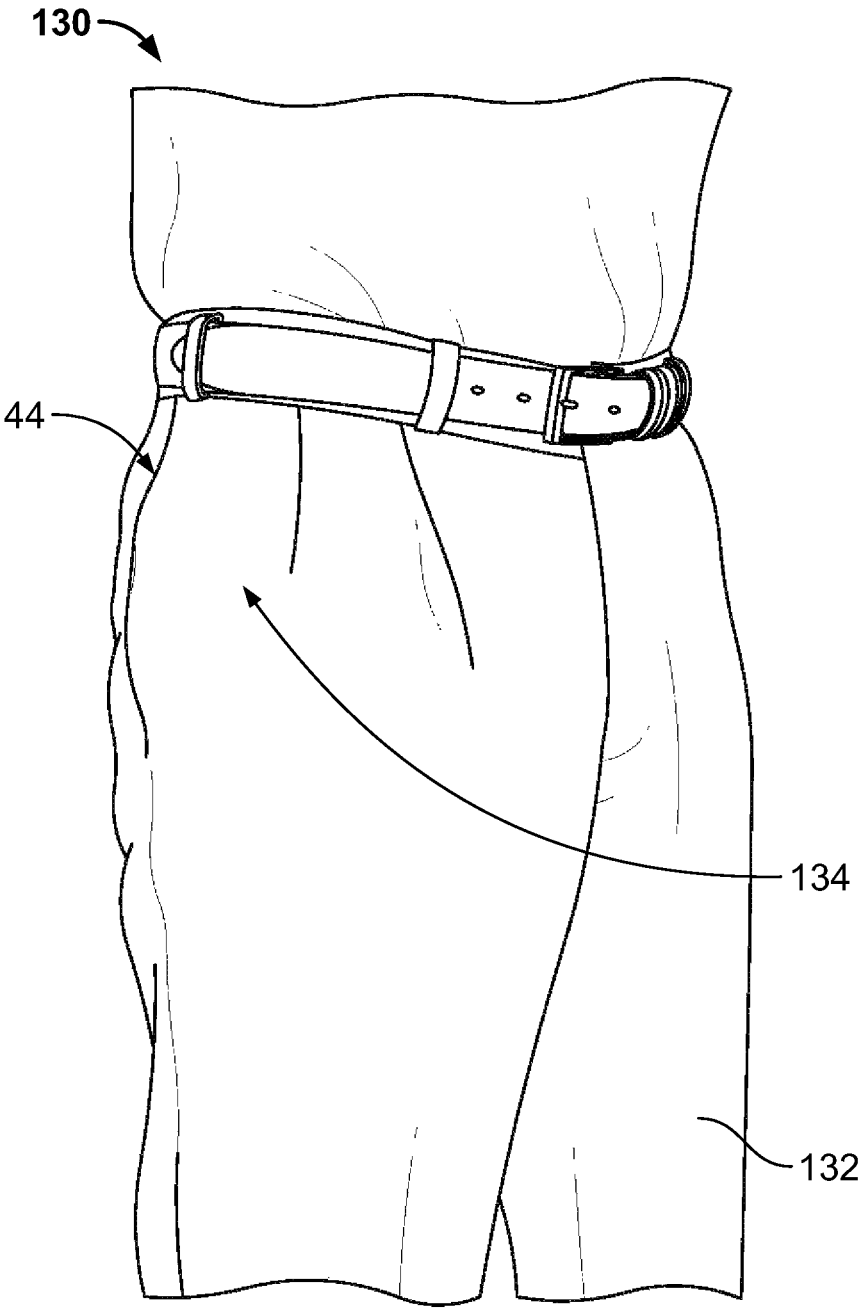
FIGS. 6A-6E collectively show the process by which a wearer wearing pants having an exemplary embodiment of the pocket of the present invention removes a handgun from the pocket.
Figure 6B:
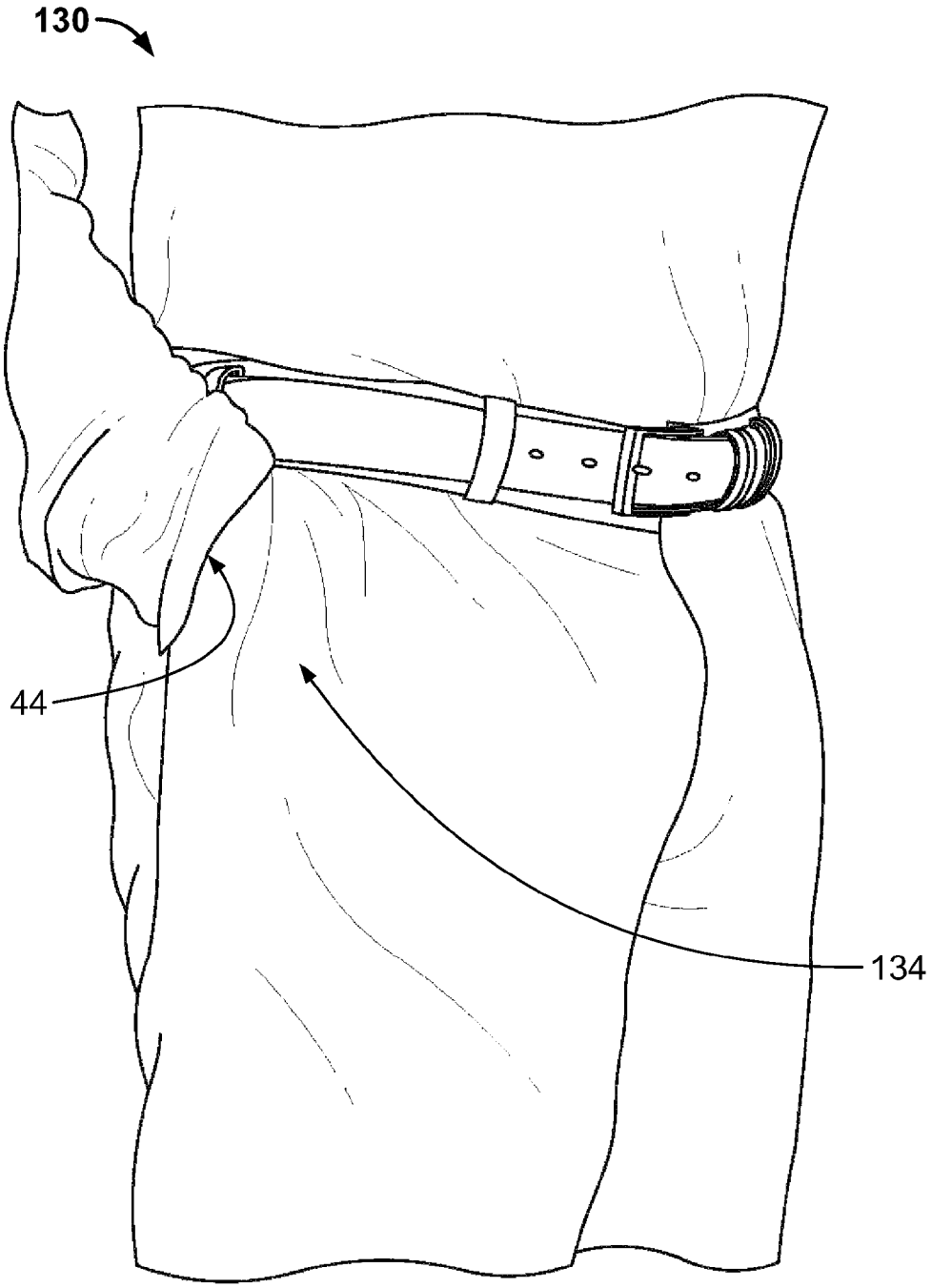
Figure 6C:
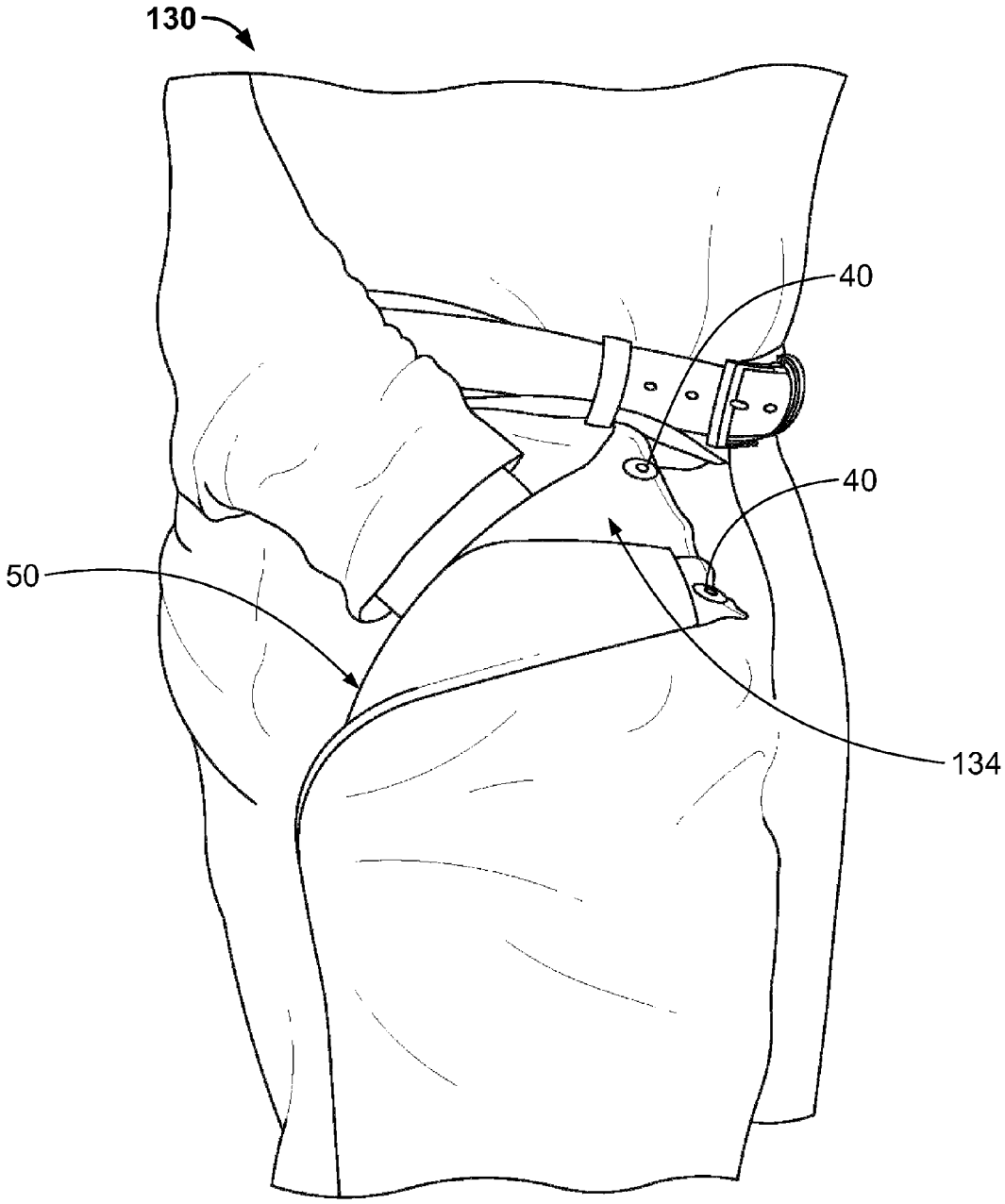
Figure 6D:
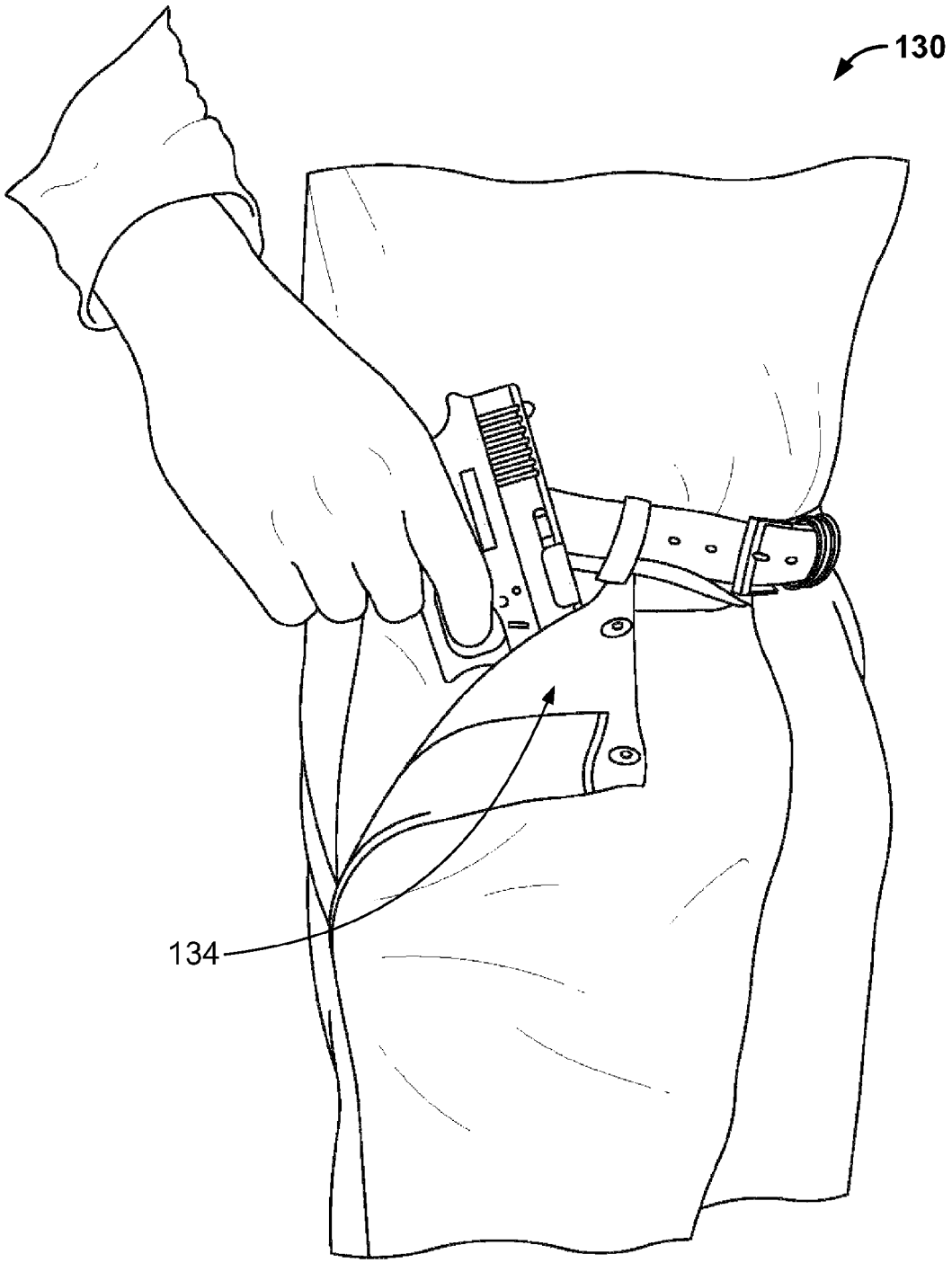
Figure 6E:
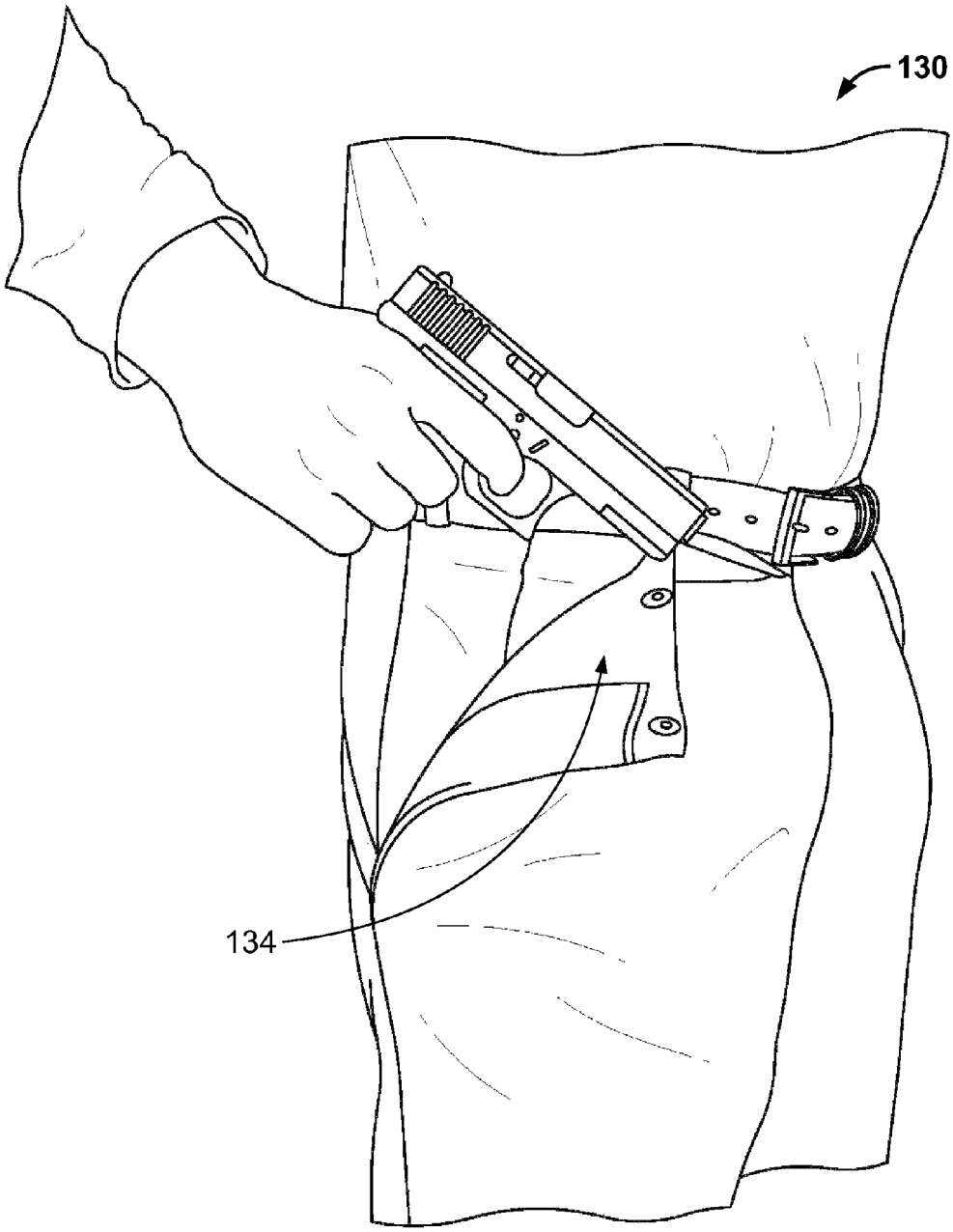

FIGS. 6A-6E collectively show the process by which wearer 130 removes a handgun from pocket 134. FIG. 6A shows the opening of pocket 134 in its first state (i.e., its unenlarged state), as represented by unenlarged pocket opening 44. As suggested by FIG. 6A, pre-existing seams of pants 132 have been used in incorporating pocket 134. FIG. 6B shows wearer 130 having inserted his hand into pocket 134 via unenlarged pocket opening 44 to grip the handgun. FIG. 6C shows wearer 130 having released readily-releasable fasteners 40, thereby changing the opening of pocket 134 from its first state to its second state (i.e., its enlarged state), as represented by enlarged pocket opening 50. The release of readily-releasable fasteners 40 can be accomplished by outward movement by wearer 130 of his wrist and/or lower forearm away from his waist. FIG. 6D shows wearer 130 removing the handgun from pocket 134. The handgun can be readily removed from pocket 134 because, inter alia, the handgun is being carried therein in an ergonomic orientation. More particularly, pocket 134, as in all other embodiments of the present invention, includes a receiving zone (see, e.g., FIG. 2 at 82) that is dimensioned to aid in maintaining the handgun in the first region (see, e.g., FIG. 2 at 72) and in an ergonomic orientation. As stated previously, ergonomic orientation refers to one or more of (1) the barrel portion (see, e.g., FIG. 2 at 84) being substantially adjacent to the inner edge 24 (see, e.g., FIG. 2 at 24); (2) the muzzle (see, e.g., FIG. 2 at 86) being substantially adjacent to the first segment (see, e.g., FIG. 2 at 28) of the base edge (see, e.g., FIG. 2 at 26) or a removable spacer; and/or (3) trigger guard (see, e.g., FIG. 2 at 88) being proximal to the first end of the first seam (see, e.g., FIG. 2 at 80, 100). The orientation of the handgun, as it is carried in pocket 134, is roughly similar to the orientation of a handgun carried in a holster. However, the position of the handgun carried in pocket 134 (i.e., within the first region) offers ergonomics that are superior to a conventional holster because wearer 130 does not have to awkwardly contort his arm and wrist to access the handgun, as he would when accessing a handgun carried in a holster. For example, the handgun is positioned further down on wearer's 130 body than a conventional holster ordinarily would be, thereby requiring less contortion of the arm and wrist to access the handgun. Additionally, the position of the handgun in the first region renders it extremely difficult for a person other than wearer 130 to access the handgun without wearer's 130 knowledge. In addition, the location of the handgun in the first region also renders it difficult for wearer 130 to lose possession of the handgun as it is being carried, even during strenuous physical activity (e.g., fighting, running, jumping). Wearer 130 also benefits from having "constant recognition" or "constant feel" that the handgun is on his person because it is carried adjacent to his inner thigh, increasing the possibility that wearer 130 would notice if it were no longer present in pocket 134. FIG. 6E shows wearer 130 having completed removing the handgun from pocket 134.

Figure 7:
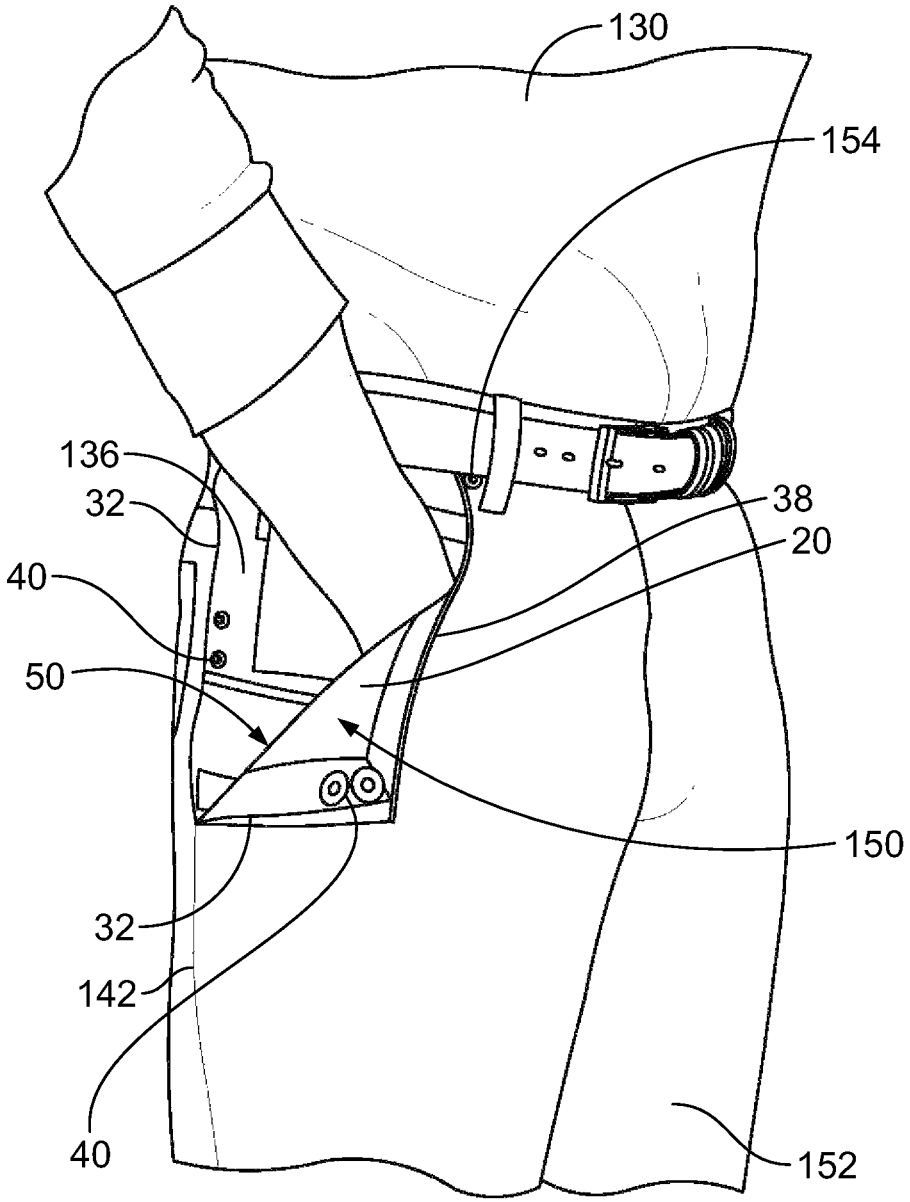
FIG. 7 is a side view of a wearer wearing a conventional pair of jeans showing another exemplary embodiment of the pocket of the present invention in an enlarged position.

FIG. 7 shows another embodiment of the pocket of the present invention. Pocket 150 is suitable for jeans (pants usually made of jean or denim) and other garments in which waist edge 38 of outer layer 20 does not substantially coincide with the waistline of the jeans or other garment. In many jeans, including jeans 152 shown in FIG. 7, the pocket opening curves downward, away from the waistline. This downward curve renders it difficult to incorporate and conceal readily-releasable fasteners 40 along waist edge 38. Also, the presence of rivet 152, which is a common feature in jeans, may interfere with providing a suitable range of release, significantly limiting the size of any resulting enlarged pocket opening. While rivet 154 could be removed, such an alteration may render it somewhat more likely that an observer will notice that jeans 152 had been modified. For these reasons, the readily-releasable fasteners 40 in pocket 150 are provided along outer edge 32 of outer layer 20, instead of along waist edge 38 of outer layer 20 (as shown in FIGS. 1, 2, and 4). Upon their release, the opening of embodiment 150 assumes its second state (i.e., its enlarged state), as represented by enlarged pocket opening 50. Despite the change in their location, release of readily-releasable fasteners 40 still can be accomplished by outward movement by wearer 130 of his wrist and/or lower forearm. As shown in FIG. 7, respective outer edges 32 of outer layer 20 and inner layer 136 substantially coincide with side seam 142. (In the interest of clarity, outer edge 32 of outer layer 20 substantially coincides with side seam 142 only when readily-releasable fasteners 40 are fastened.) Where possible, pre-existing seams of jeans 152 are used in incorporating pocket 150, to minimize the possibility that an observer will notice that jeans 152 have been modified. Pocket 150 evidences that the present invention can be adapted to suit a variety of pants. In another embodiment, rivet 154 can be removed and replaced with a readily-releasable fastener 40 that has an appearance similar to a rivet. In a further embodiment, the pocket 134 can have releasable fasteners 40 on both waist edge 38 and outer edge 32.

Each of the embodiments of the pocket of the present invention disclosed herein enables its wearer to carry, in a concealed and readily-accessible state, a handgun or other object. Each embodiment minimizes the telegraphing of the handgun or other object and also renders it extremely difficult for a person other than the wearer to access the handgun or other object carried therein without the wearer's knowledge. Furthermore, it is difficult for the wearer to lose possession of the handgun or other object in each embodiment, including even while the wearer is engaging in strenuous physical activity (e.g., fighting, running, jumping). None of the embodiments significantly compromises the wearer's freedom of movement because the handgun or other object does not intersect (1) the line of flexion of the wearer's hip joint or (2) the line of flexion of the wearer's knee joint. For example, the ability of the wearer to kneel, run, and sit is not significantly compromised. The wearer also benefits from having "constant recognition" or "constant feel" that the handgun or other object is on his person because it is carried adjacent to his inner thigh, increasing the possibility that the wearer would notice if it went missing.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A pant garment for a person, the garment comprising:

a pant body having an outer layer with an inseam, a waistband, and leg portions;

the waistband having a top edge and a bottom edge, the bottom edge having attached segments and unattached segments, the attached segments of the bottom edge are stitched to the pant body and the unattached segments of the bottom edge are free from attachment allowing access to the pant body underneath the waistband;

a pocket attached to the pant body and positioned underneath the outer layer, the pocket comprising:

a first layer having an exterior surface and an interior surface;

a second layer having an exterior surface and an interior surface, the second layer is positioned opposite the first layer and attached to the first layer forming a partially enclosed space;

a first edge extending along a waistline of the pant body;

a second edge extending from the first edge;

a third edge positioned opposite the first edge and extending from the second edge;

a fourth edge positioned opposite the second edge and extending from the third edge to the first edge;

an opening positioned along the fourth edge;

a plurality of fasteners located along the first edge on the interior surface of the first layer;

a plurality of corresponding fasteners located along the first edge on the exterior surface of the second layer and positioned underneath the unattached segments of the bottom edge of the waistband;

wherein the plurality of fasteners and the plurality of corresponding fasteners when mated are concealed by the waistband;

wherein upon release of the plurality of fasteners and the plurality of corresponding fasteners, the opening is converted from a first size to a second size, the second size of the opening being larger than the first size of the opening.

2. The garment of claim 1, wherein the plurality of fasteners and the plurality of corresponding fasteners are configured to be releasable by a hand of a user present in the partially enclosed space.

3. The garment of claim 2, wherein the plurality of fasteners and the plurality of corresponding fasteners are configured to be releasable by movement of at least one of a wrist or forearm of the user.

4. The garment of claim 1, wherein a fastener is positioned along the fourth edge and the opening further extends along the fourth edge to form the second size.

5. The garment of claim 1, wherein the plurality of fasteners and the plurality of corresponding fasteners comprise one of a snap fastener or a hook and loop fastener.

6. The garment of claim 1, further comprising:

a first seam extending from an intermediate point of the third edge toward the first edge for a predetermined distance to an end of the first seam, the first seam being positioned parallel to the second edge over the predetermined distance;

the third edge comprising a segment, the segment extending from the second edge to the first seam;

the first seam, the segment and the second edge define a receiving zone to store an object; and the first seam is positioned to orient the object in the receiving zone and to prevent lateral movement of the object in the receiving zone.

7. The garment of claim 6, wherein the object comprises a handgun having a barrel and a muzzle being positioned in the region.

8. The garment of claim 7, wherein the second size of the opening permits a user to withdraw the handgun from the region and the partially enclosed space.

* * * * *